US011621516B2

(12) United States Patent
Chi et al.

(10) Patent No.: US 11,621,516 B2
(45) Date of Patent: Apr. 4, 2023

(54) ELECTRICAL CONNECTOR AND CONNECTOR ASSEMBLY

(71) Applicant: LUXSHARE PRECISION INDUSTRY COMPANY LIMITED, Shenzhen (CN)

(72) Inventors: Hong Chi, Shenzhen (CN); LingLi Chang, Shenzhen (CN)

(73) Assignee: LUXSHARE PRECISION INDUSTRY COMPANY LIMITED, Shenzhen (CN)

( * ) Notice: Subject to any disclaimer, the term of this patent is extended or adjusted under 35 U.S.C. 154(b) by 0 days.

(21) Appl. No.: 17/465,450

(22) Filed: Sep. 2, 2021

(65) Prior Publication Data

US 2022/0166160 A1 May 26, 2022

(30) Foreign Application Priority Data

Nov. 23, 2020 (CN) ..... 202022726410.8

(51) Int. Cl.
*H01R 13/502* (2006.01)
*H01R 13/52* (2006.01)

(52) U.S. Cl.
CPC ..... *H01R 13/5202* (2013.01); *H01R 13/502* (2013.01); *H01R 13/5213* (2013.01)

(58) Field of Classification Search
CPC ..... H01R 13/5202; H01R 13/502; H01R 13/5213
See application file for complete search history.

(56) References Cited

U.S. PATENT DOCUMENTS

| | | | | |
|---|---|---|---|---|
| 8,388,380 | B1 * | 3/2013 | Van der Steen | H01R 13/5202 439/607.36 |
| 10,998,669 | B2 * | 5/2021 | Mamiya | H01R 13/447 |
| 2011/0045696 | A1 * | 2/2011 | Nakamura | H01R 13/5202 439/587 |
| 2014/0065865 | A1 * | 3/2014 | Mizutani | H01R 13/5219 439/271 |
| 2020/0153154 | A1 * | 5/2020 | Mamiya | H01R 13/5202 |

FOREIGN PATENT DOCUMENTS

| | | | | |
|---|---|---|---|---|
| EP | 2362494 | A1 * | 8/2011 | H01R 13/5202 |
| KR | 20100057188 | A * | 5/2010 | H01R 13/5202 |
| WO | WO-2012163736 | A1 * | 12/2012 | B60L 3/0069 |
| WO | WO-2013041439 | A2 * | 3/2013 | H01R 13/5202 |

* cited by examiner

*Primary Examiner* — Tho D Ta
(74) *Attorney, Agent, or Firm* — Birch, Stewart, Kolasch & Birch, LLP

(57) ABSTRACT

The present disclosure provides an electrical connector and a connector assembly. The electrical connector comprises a first sleeve, a first cover, and a sealing member. The first sleeve comprises a first mating opening and a first connecting end surface. The first connecting end surface is disposed at the periphery of the first mating opening. The first cover is disposed in the first sleeve. The first cover comprises a first mating surface exposed from the first mating opening. The sealing member is disposed on a side surface of the first cover and surrounds the first cover. The sealing member is disposed between the first sleeve and the first cover. The sealing member comprises a sealing sheet extending from the first mating surface in a direction close to the first connecting end surface of the first sleeve.

19 Claims, 11 Drawing Sheets

ELECTRICAL CONNECTOR AND CONNECTOR ASSEMBLY

CROSS-REFERENCE TO RELATED APPLICATION

This application claims the priority benefit of Chinese Patent Application Serial Number 202022726410.8, filed on Nov. 23, 2020, the full disclosure of which is incorporated herein by reference.

BACKGROUND

Technical Field

The present disclosure relates to the technical field of connector, particularly to an electrical connector and a connector assembly.

Related Art

In conventional connectors, the joint where a male connector connects with a female connector is provided with a waterproof ring to prevent external water and moisture from entering the connector through the gap between the male connector and the female connector to keep the internal electrical components (such as circuit boards, terminals, etc.) from being corroded and damaged. The waterproof ring is usually disposed at the male connector or the female connector. When the waterproof ring is installed on the male connector, the required standard for dimensional accuracy and flatness to the male connector are more strict than to the female connector when installing on the female connector. The female connector, when connecting with the male connector, it would be pressed and interfered with the waterproof ring to achieve the effect of waterproofing. However, the waterproof ring is prone to wear and elastically fatigue due to frequent plugging and unplugging of the connectors. Thus, the waterproofing performance would be lowered, and the service life of the waterproof ring would be shortened.

SUMMARY

The embodiments of the present disclosure provide an electrical connector and a connector assembly tended to solve the problem of lowered waterproofing performance of the waterproof ring which is prone to wear and elastically fatigue due to frequent plugging and unplugging of the connectors.

In one embodiment, an electrical connector is provided, which comprises a first sleeve, a first cover, and a sealing member. The first sleeve comprises a first mating opening and a first connecting end surface. The first connecting end surface is disposed at the periphery of the first mating opening. The first cover is disposed in the first sleeve. The first cover comprises a first mating surface exposed from the first mating opening. The sealing member is disposed on a side surface of the first cover and surrounds the first cover. The sealing member is disposed between the first sleeve and the first cover. The sealing member comprises a sealing sheet extending from the first mating surface in a direction close to the first connecting end surface of the first sleeve.

In another embodiment, a connector assembly is provided, which comprises an electrical connector according to the above embodiment and a mating connector. The mating connector comprises a second sleeve and a second cover.

The second cover is disposed in the second sleeve. The second sleeve comprises a second connecting end surface. The second cover protrudes from the second connecting end surface. When the mating connector is connected with the electrical connector, one side of the sealing sheet close to the first connecting end surface is in contact with the second connecting end surface of the second sleeve and a side surface of the second cover.

In the embodiments of the present disclosure, the sealing sheet is in contact with the second connecting end surface of the second sleeve of the mating connector and the side surface of the second cover to perform waterproofing of the electrical connector, which reduces friction between the mating connector and the sealing sheet of the sealing member during plugging and unplugging to avoid wear and elastic fatigue of the sealing member. Thus, the waterproof performance of the sealing member could be maintained in excellent condition when it is used for a longer period of time, and the service life of the sealing member can be greatly increased.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

Figure 1:
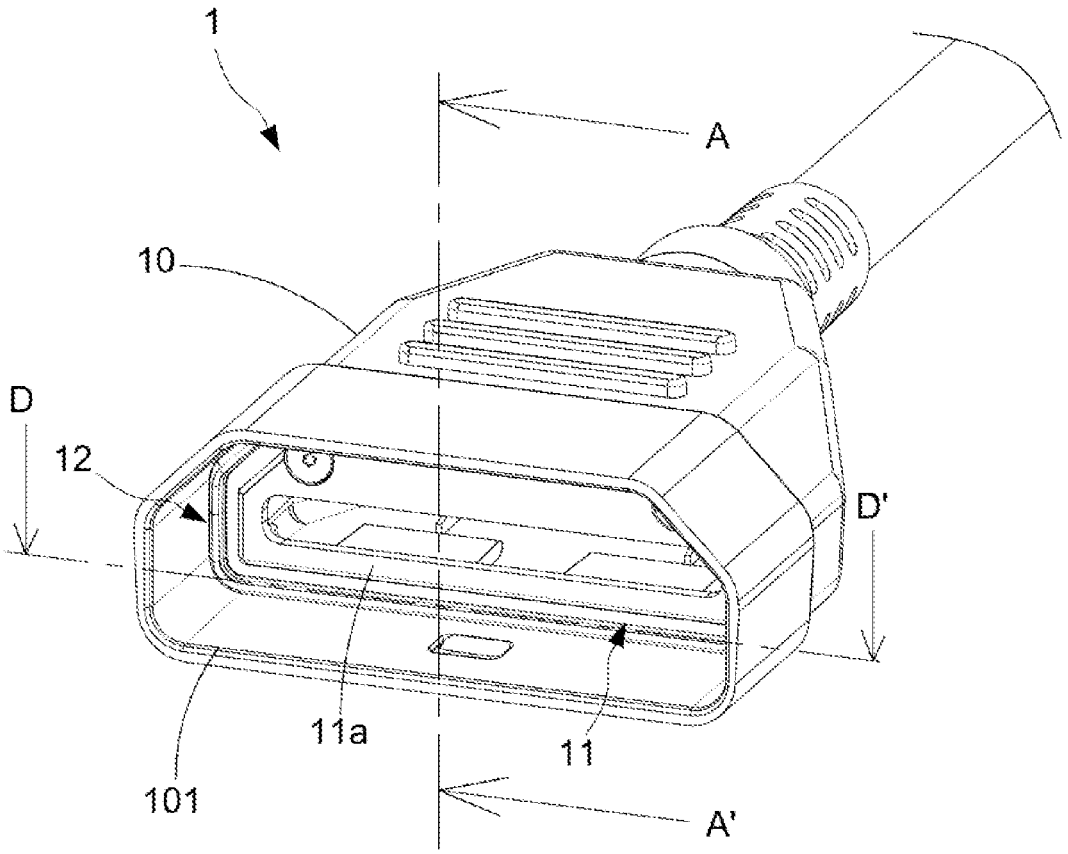
FIG. 1 is a perspective view of an electrical connector of the first embodiment of the present disclosure.
Figure 2:
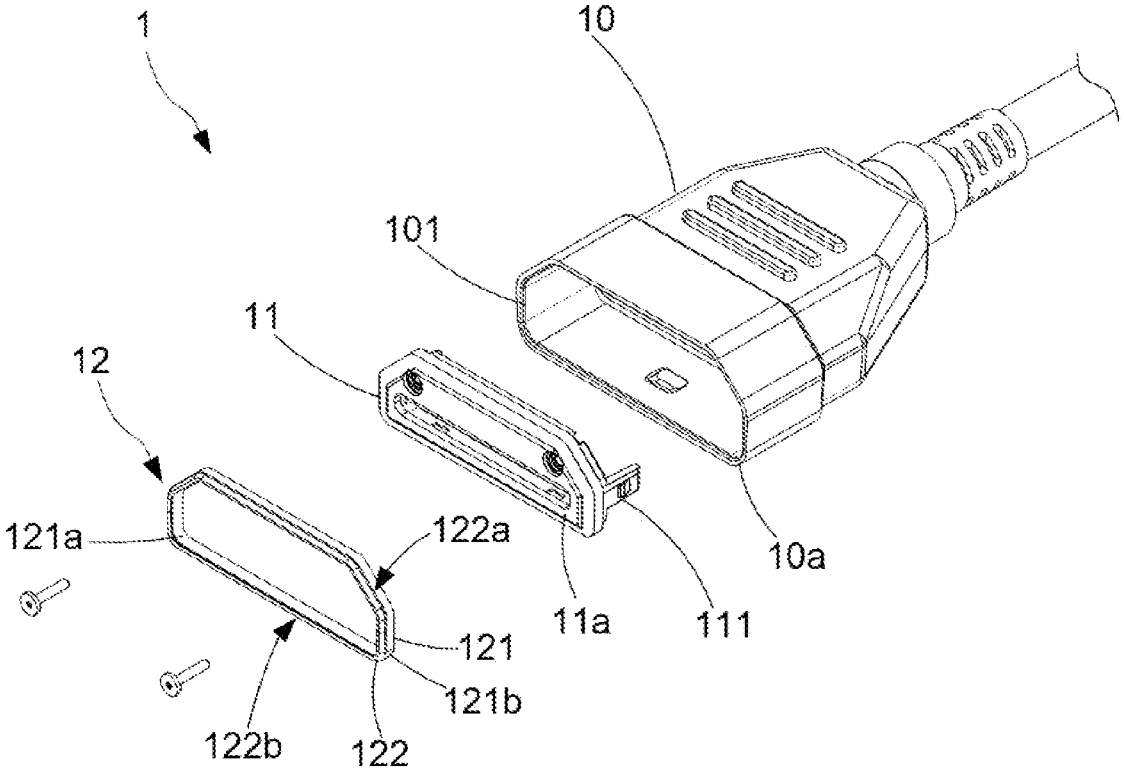
FIG. 2 is an exploded view of the electrical connector of the first embodiment of the present disclosure.
Figure 3:
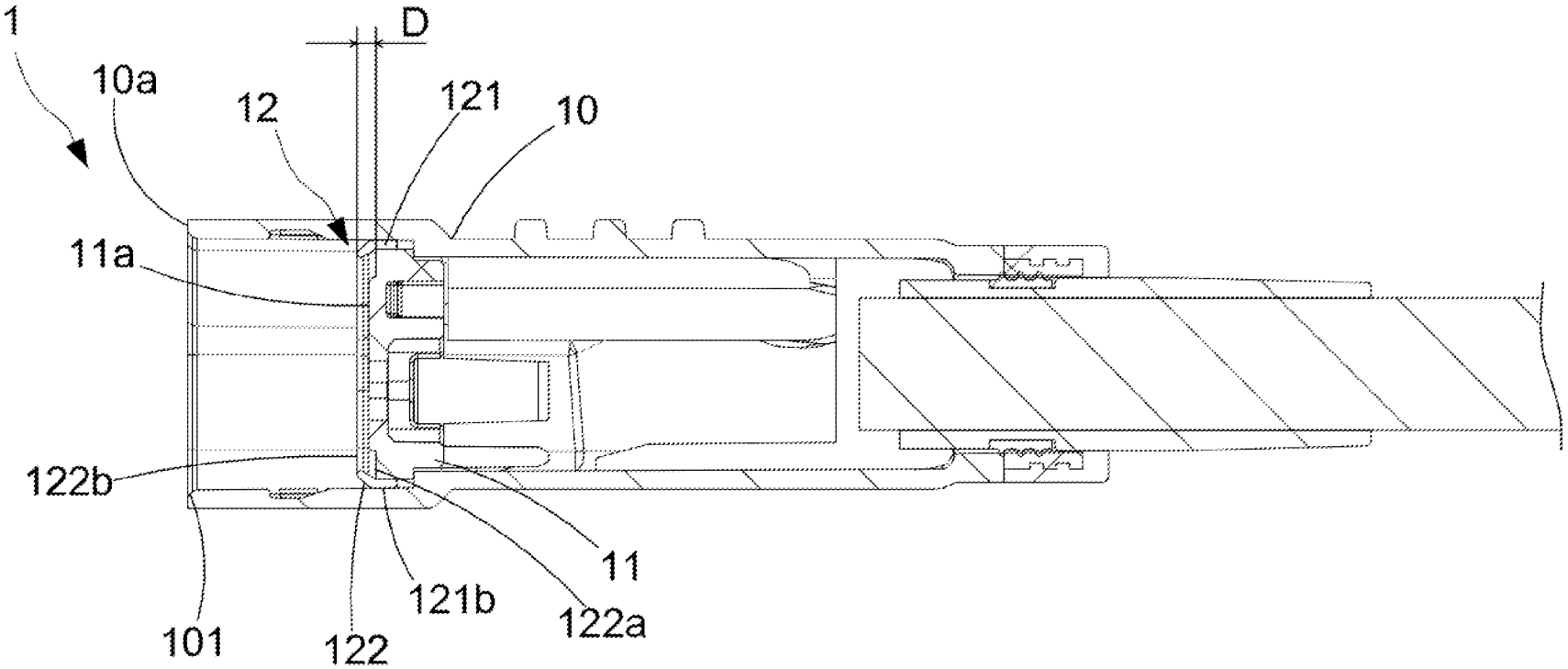
FIG. 3 is a cross-sectional view along line A-A' in FIG. 1.

FIG. 1 and FIG. 2 are perspective view and exploded view of an electrical connector of the first embodiment of the present disclosure. FIG. 3 is a cross-sectional view along line A-A' in FIG. 1. As shown in the figures, in this embodiment, the electrical connector 1 comprises a first sleeve 10, a first cover 11, and a sealing member 12. The first sleeve 10 comprises a first mating opening 101 for accommodating a connector body (not shown). The first cover 11 is disposed in the first sleeve 10 to secure the connector body in the first sleeve 10. The first cover 11 comprises a first mating surface 11*a* exposed from the first mating opening 101. One end of the first sleeve 10 comprising the first mating opening 101 protrudes from the first mating surface 11*a*. The first sleeve 10 comprises a first connecting end surface 10*a* disposed at the periphery of the first mating opening 101. The first connecting end surface 10*a* is parallel to the first mating surface 11*a*. A gap distance exists between the first connecting end surface 10*a* and the first mating surface 11*a*. The sealing member 12 is disposed on a side surface of the first cover 11 and surrounds the first cover 11. The sealing member 12 is disposed between the first sleeve 10 and the first cover 11. In one embodiment, the sealing member 12 is disposed on the periphery of the first matting surface 11*a*.

The sealing member 12 comprises a sealing body 121 and a sealing sheet 122 which are both annular-shaped The sealing body 121 comprises an inner side edge 121*a* and an outer side edge 121*b* opposite to the inner side edge 121*a*. The sealing sheet 122 comprises a first side 122*a* and a second side 122*b*. The first side 122*a* of the sealing sheet 122 is connected with the sealing body 121. The sealing sheet 122 extends in a direction away from the sealing body 121. The sealing sheet 122 is disposed on one side of the sealing body 121. A gap distance D exists between a side edge of the second side 122*b* of the sealing sheet 122 and the sealing body 121. In one embodiment, the second side 122*b* of the sealing sheet 122 extends from the first side 122*a* in a direction away from the sealing body 121. The extending length of the sealing sheet 122 between the first side 122*a* and the second side 122*b* is greater than the gap distance D. So, the sealing sheet 122 of this embodiment is inclined to the sealing body 121. When the sealing member 12 is disposed on the first cover 11, the sealing body 121 would be disposed on the side surface of the first cover 11 and surrounds the first cover 11. The sealing sheet 122 extends from the first mating surface 11*a* in a direction toward the first connecting end surface 10*a* of the first sleeve 10. In this embodiment, the sealing member 12 is made of elastic material.

Figure 4:
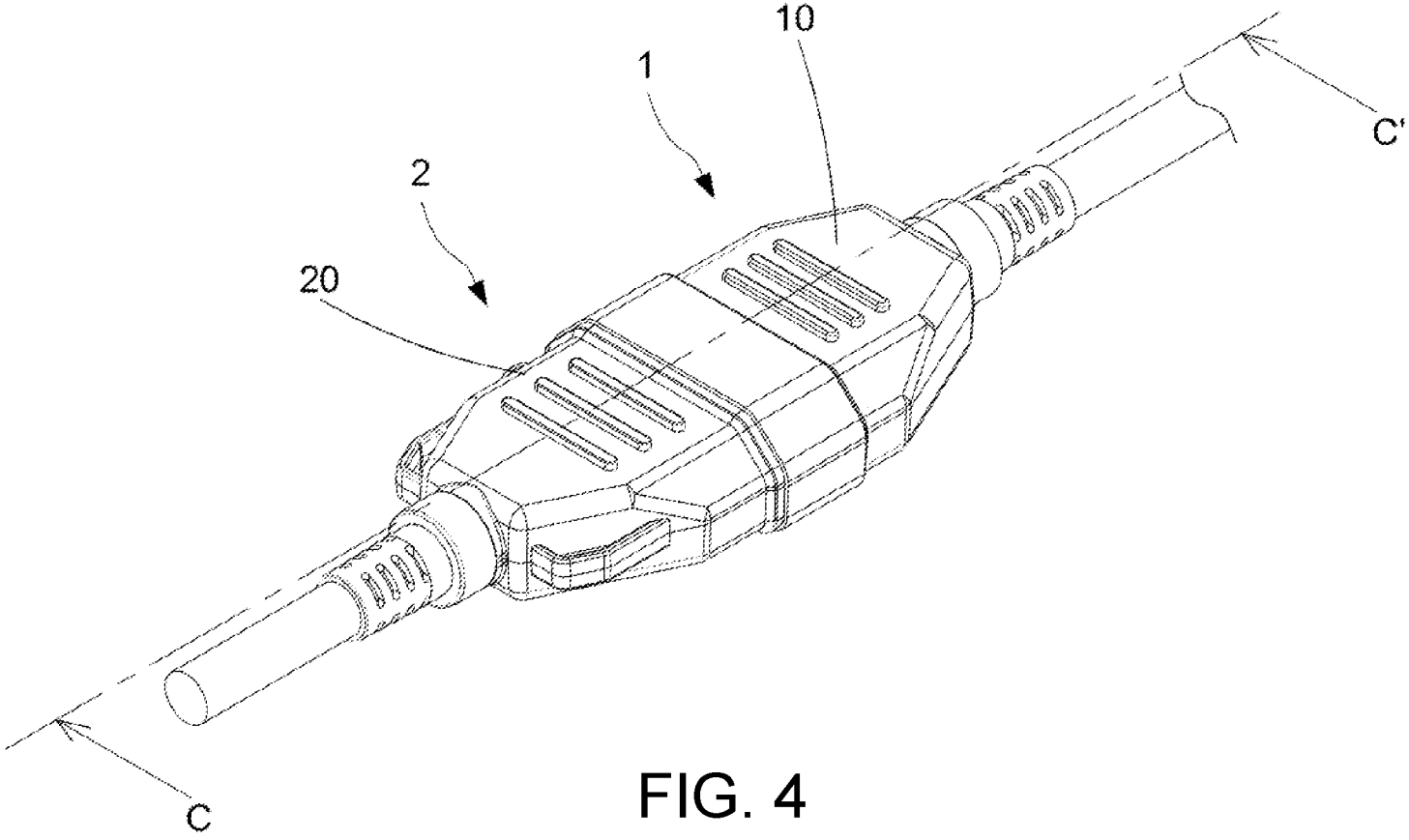
FIG. 4 is a perspective view of a connector assembly of the first embodiment of the present disclosure.
Figure 5:
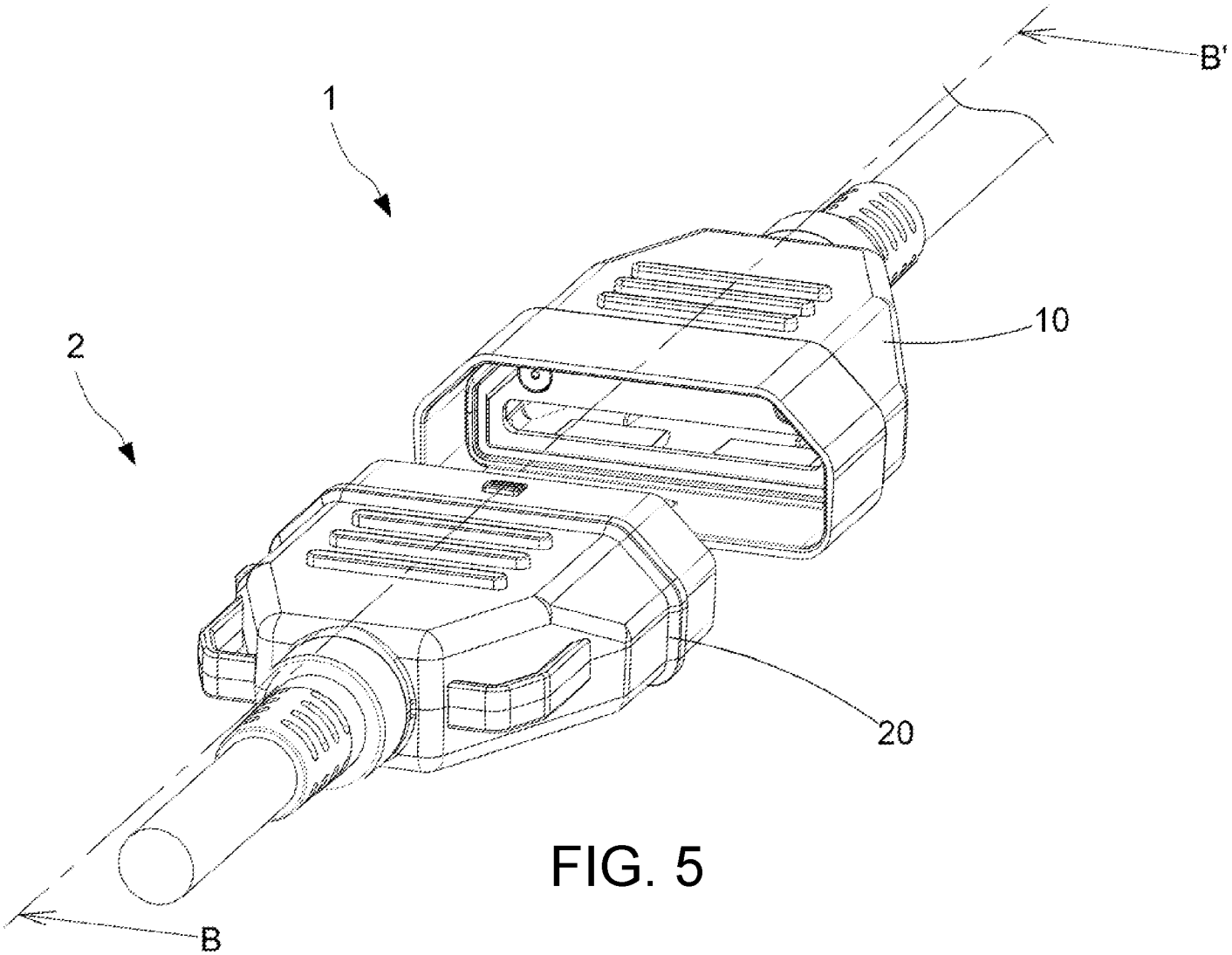
FIG. 5 is an exploded view of the connector assembly of the first embodiment of the present disclosure.
Figure 6:
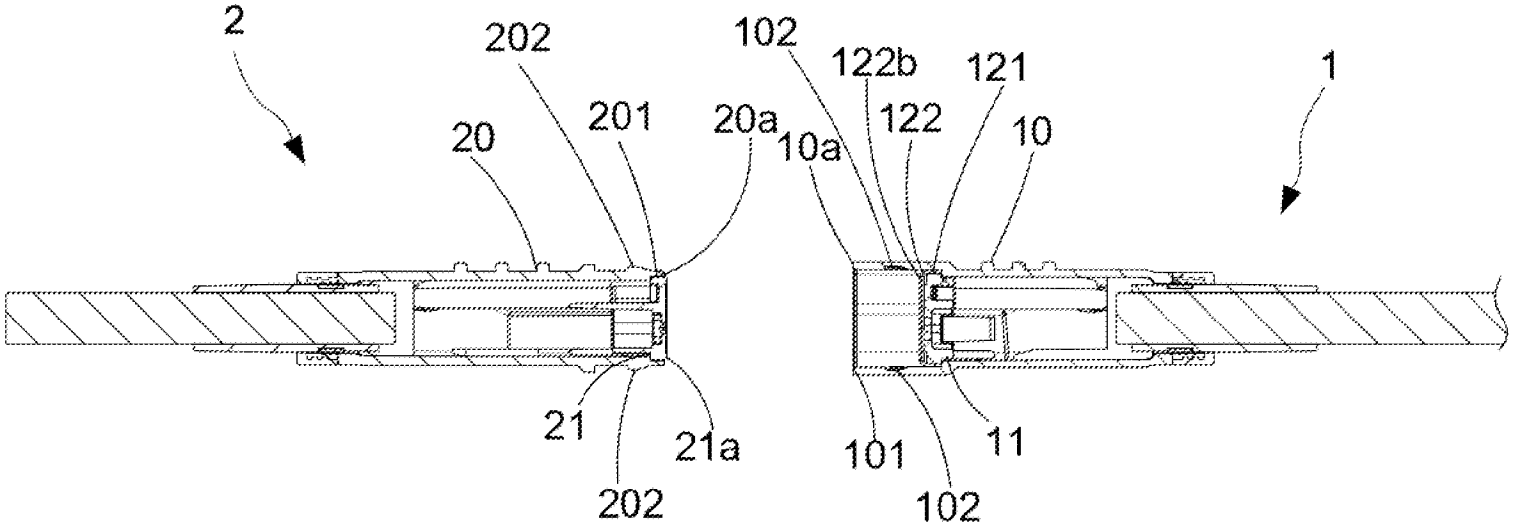
FIG. 6 is a cross-sectional view along line B-B' in FIG. 5.

FIG. 4 and FIG. 5 are perspective view and exploded view of a connector assembly of the first embodiment of the present disclosure. FIG. 6 is a cross-sectional view along line B-B' in FIG. 5. As shown in the figures, the mating connector 2 connected with the electrical connector 1 comprises a second sleeve 20 and a second cover 21. The second sleeve 20 comprises a second mating opening 201 and a second connecting end surface 20*a* disposed at the periphery of the second mating opening 201. The second sleeve 20 accommodates a mating connector body (not shown). The second cover 21 is disposed in the second sleeve 20 and protrudes from the second connecting end surface 20*a* to secure the mating connector body in the second sleeve 20. The second cover 21 comprises a second mating surface 21*a*. A gap distance exists between the second mating surface 21*a* and the second connecting end surface 20*a*. A part of a side surface of the second cover 21 is exposed from the second sleeve 2.

Figure 7:
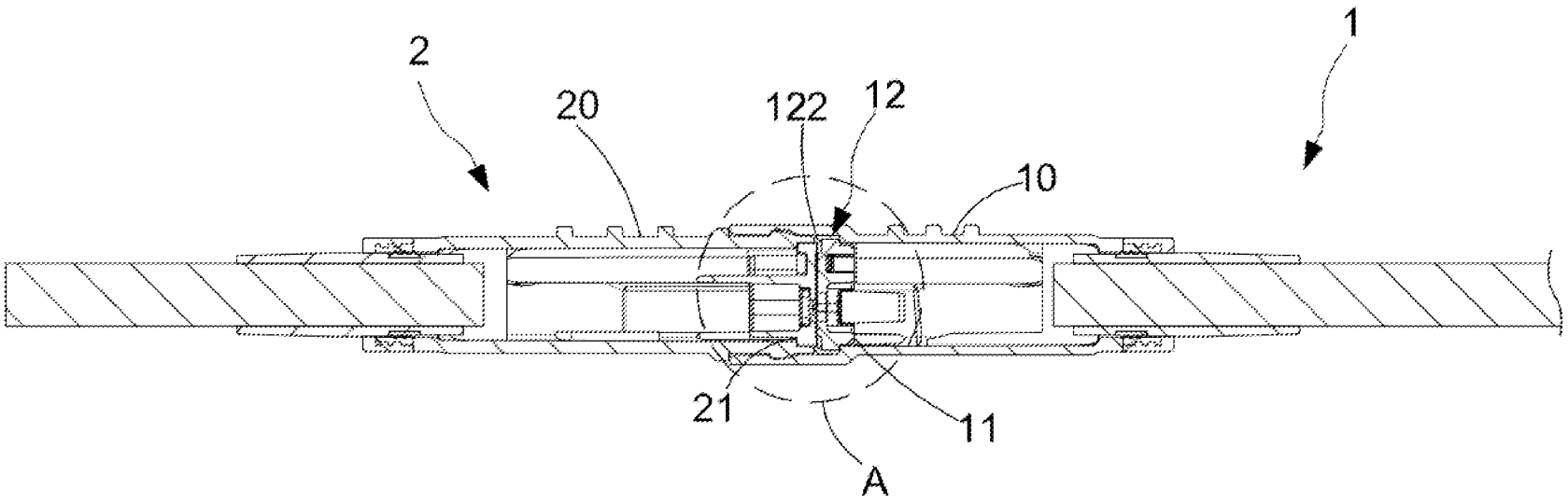
FIG. 7 is a cross-sectional view along line C-C' in FIG. 4.
Figure 8:
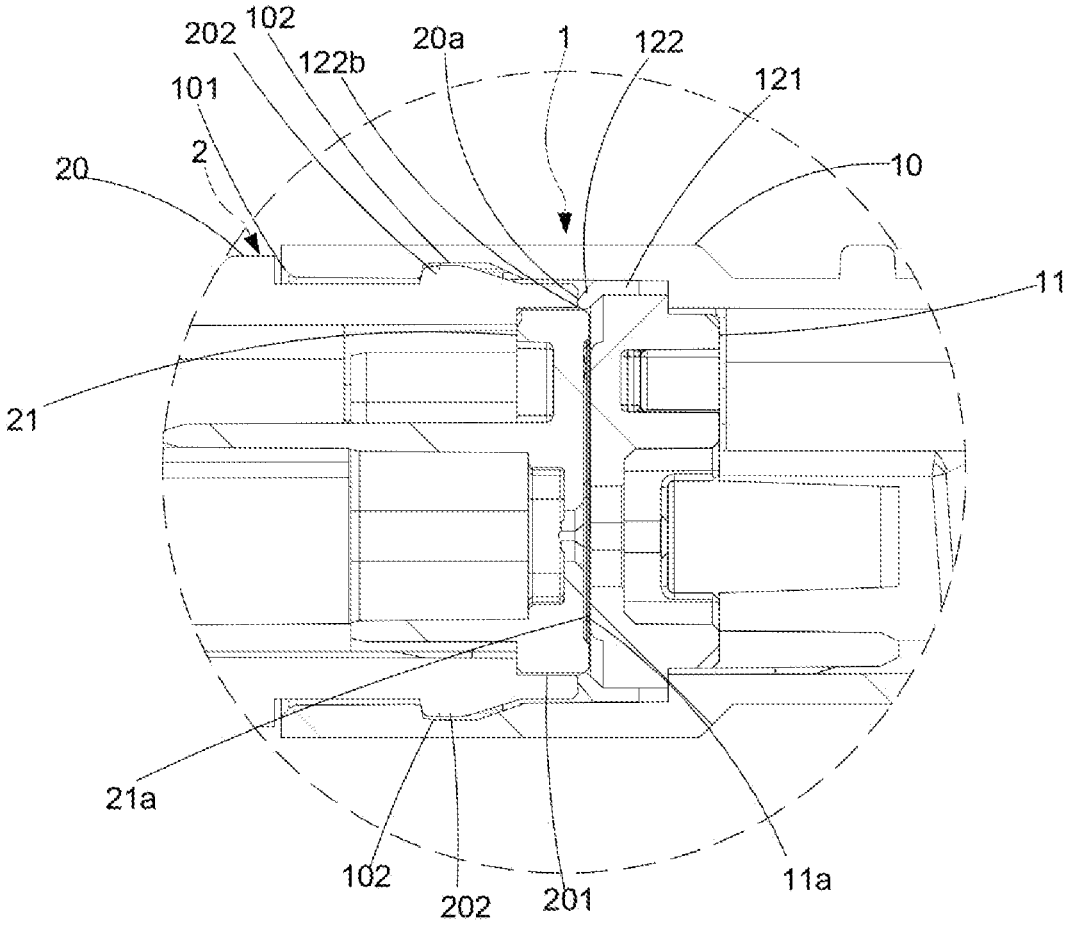
FIG. 8 is an enlarged view of area A of FIG. 7.

FIG. 7 is a cross-sectional view along line C-C' in FIG. 4. FIG. 8 is an enlarged view of area A of FIG. 7. As shown in the figures, when the mating connector 2 is connected with the electrical connector 1, the mating connector 2 would enter the first sleeve 10 from the first mating opening 101, the second cover 21 of the mating connector 2 would pass through the sealing sheet 122, and a side edge of the second side 122*b* of the sealing sheet 122 would be in contact with a side surface of the second cover 21 and the second connecting end surface 20*a* of the second sleeve 20. When the mating connector 2 is closing to the electrical connector 1, the second mating surface 21*a* would be closing to the first mating surface 11*a* accordingly. In this way, the second connecting end surface 20*a* of the second sleeve 20 of the mating connector 2 would push the sealing sheet 122 to move closer to the sealing body 121 to reduce the gap distance D (see FIG. 3) between the side edge of the second side 122*b* of the sealing sheet 122 and the sealing body 121. Meanwhile, the side edge of the second side 122*b* of the sealing sheet 122 would extend toward the side surface of the second cover 21, and the side surface of the second cover 21 would compress the sealing sheet 122, and the compressed sealing sheet 122 would generate an elastic force which would be applied to the side surface of the second cover 21, allowing one side of the sealing sheet 122 close to the first connecting end surface 10*a* to firmly abut against the side surface of the second cover 21. In this way, external moisture can be effectively prevented from entering the gap between the first mating surface 11*a* and the second mating surface 21*a*. In one embodiment, the sealing sheet 122 is made of elastic material, such as but not limited to silicone. The second connecting end surface 20*a* and the side surface of the second cover 21 jointly compress the sealing sheet 122, and an elastic force generated by the compressed sealing sheet 122 would be applied to the second connecting end surface 20*a* and the side surface of the second cover 21 simultaneously, allowing one side of the sealing sheet 122 close to the first connecting end surface 10*a* to firmly and simultaneously abut against the second connecting end surface 20*a* and the side surface of the second cover 21. Alternatively, the second connecting end surface 20*a* compresses the sealing sheet 122, so that the sealing sheet 122 can be elastically deformed and bent toward the side surface of the second cover 21. One side of the sealing sheet 122 close to the first connecting end surface 10*a* can firmly and simultaneously abut against the second connecting end surface 20*a* and the side surface of the second cover 21 through the elastic restoring force of the elastic deformation of the sealing sheet 122. In this embodiment, the sealing member 12 is waterproof due to the contact between the sealing sheet 122 and the mating connector 2. During the plugging and unplugging process, the mating connector 2 would not friction with the sealing member 12, and the sealing sheet 122 of the sealing member 12 is in frontal contact with the mating connector 2 in the plugging and unplugging direction. In this way, wearing and elastic fatigue of the sealing member 12 can be avoided, keeping the sealing member 12 with excellent waterproof performance to increase the service life of the sealing member 12.

In this embodiment, two opposite inner surfaces of the first sleeve 10 are respectively provided with a positioning groove 102. Each of the positioning grooves 102 is disposed between the first connecting end surface 10*a* of the first sleeve 10 and the first mating surface 11*a* of the first cover 11. Two opposite outer surfaces of the second sleeve 20 are respectively provided with a positioning bump 202. Each of the positioning bumps 202 is close to one end of the second sleeve 20 comprising a second mating opening 201. When the mating connector 2 is connected with the electrical connector 1, the positioning bump 202 would enter the corresponding positioning groove 102 to prevent the mating connector 2 from being detached from the electrical connector 1 due to any possible accidental touch.

In this embodiment, the mating connector 2 is mated with the electrical connector 1 to form a connector assembly. The connector body of the electrical connector 1 and the mating connector body of the mating connector 2 can be a male connector and a female connector, respectively. The connector body of the electrical connector 1 and the mating connector body of the mating connector 2 are respectively connected to the outside of the connectors through a cable.

Back to FIG. 3, in this embodiment, since the outer side edge 121*b* of the sealing body 121 is in contact with the inner surface of the first sleeve 10, the sealing member 12 can seal the gap between the inner surface of the first sleeve 10 and the side surface of the first cover 11. In this way, external moisture can be prevented from entering the gap between the inner surface of the first sleeve 10 and the side surface of the first cover 11 to increase the waterproofness of the electrical connector 1.

In this embodiment, the cross-sectional area of the sealing sheet 122 along a direction orthogonal to the first mating surface 11*a* is an inclined surface, which can also be an arc-surface or a bent surface as long as a gap distance D between the second side 122*b* of the sealing sheet 122 and the sealing body 121 exists, and the second side 122*b* of the sealing sheet 122 extends from the first side 122*a* in a direction away from the sealing body 121 for achieving the effects described above. In one embodiment, the extending direction of the sealing sheet 122 from the sealing body 121 is inclined to the direction orthogonal to the first mating surface 11*a*.

Figure 9:
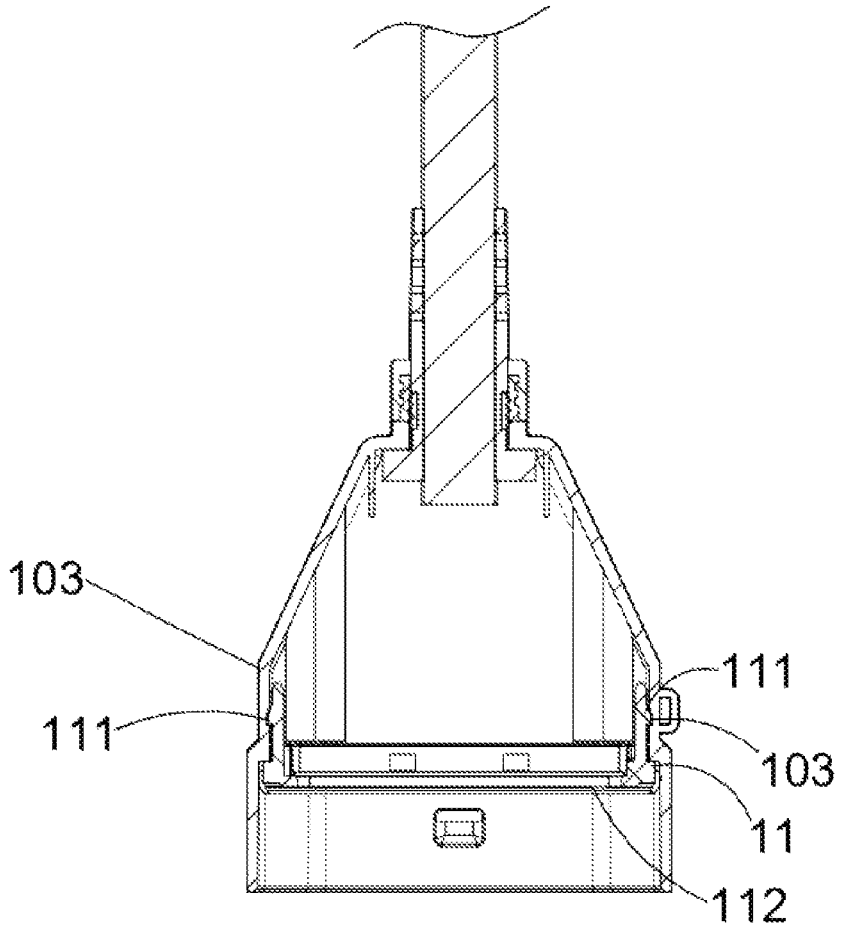
FIG. 9 is a cross-sectional view along line D-D' in FIG. 1.

FIG. 9 is a cross-sectional view along line D-D' in FIG. 1. Referring to FIG. 3 and FIG. 9, two opposite sides of the first cover 11 are respectively provided with a buckle 111. Each of the buckles 111 is disposed on one side of the first cover 11 opposite to the first mating surface 11*a* and extends in a direction away from the first mating surface 11*a*. The two opposite inner surfaces of the first sleeve 10 respectively comprise a recess 103. When the first cover 11 is disposed in the first sleeve 10, each of the buckles 111 would be buckled with the corresponding recess 103 to secure the first cover 11 in the first sleeve 10. In this embodiment, the first cover 11 can also be secured in the first sleeve 10 through a securing member, so that the first cover 11 can be firmly connected with the first sleeve 10.

Figure 10:
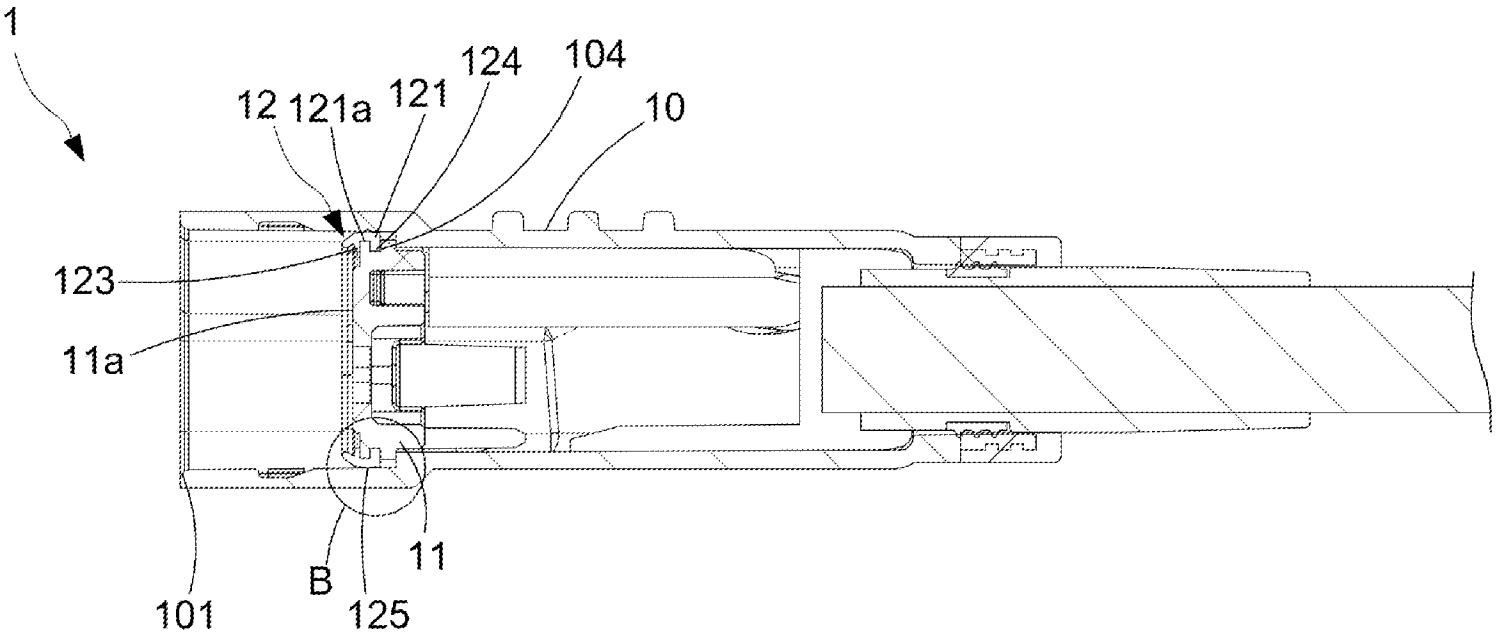
FIG. 10 is a cross-sectional view of an electrical connector of the second embodiment of the present disclosure.
Figure 11:
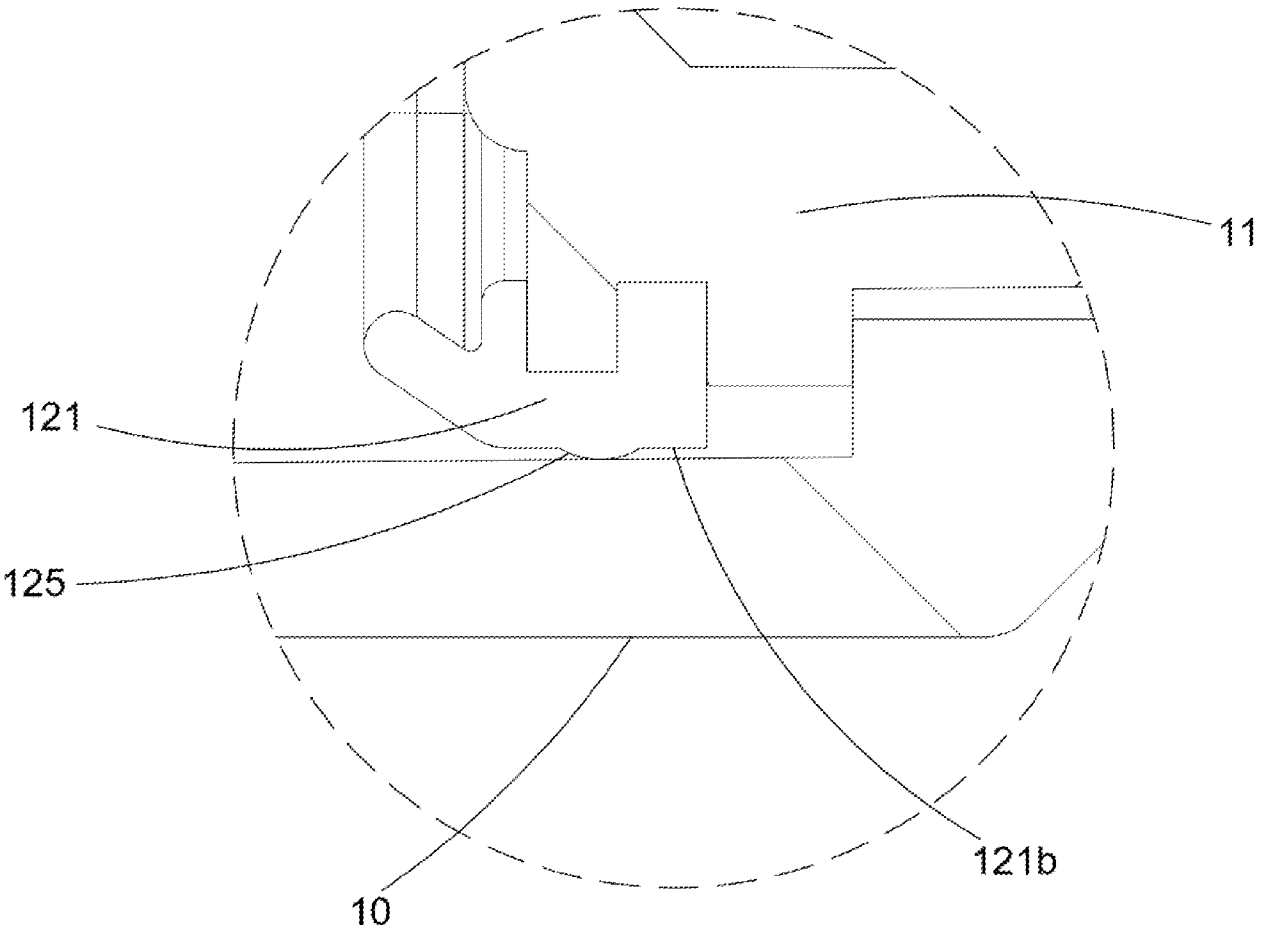
FIG. 11 is an enlarged view of area B of FIG. 10.

FIG. 10 is a cross-sectional view of an electrical connector of the second embodiment of the present disclosure. FIG. 11 is an enlarged view of area B of FIG. 10. As shown in the figures, the electrical connector 1 of this embodiment is different from that of the first embodiment in the structural configuration of the sealing member 12. In this embodiment, the sealing member 12 further comprises a positioning sheet 123. The positioning sheet 123 is disposed on an inner side edge 121*a* of the sealing body 121 and extends into an inner space surrounded by the sealing body 121. When the sealing member 12 is disposed on the first cover 11, the positioning sheet 123 would cover a part of the first mating surface 11*a* of the first cover 11, and the sealing sheet 122 would protrude from the first mating surface 11*a* to position the sealing member 12 on the first cover 11. In one embodiment, the positioning sheet 123 surrounds and contacts the periphery of the first mating surface 11*a*.

In this embodiment, the sealing member 12 further comprises a securing sheet 124. The securing sheet 124 is disposed on the inner side 121*a* of the sealing body 121 and extends into the inner space surrounded by the sealing body 121. The securing sheet 124 and the positioning sheet 123 are disposed on the inner side edge 121*a* of the sealing body 121 at intervals. When the sealing member 12 is disposed on the first cover 11, the securing sheet 124 would be embedded into the connector body. That is, the side surface of the first cover 11 further comprises a connecting groove 104 in which the securing sheet 124 is disposed to secure the sealing member 12 on the first cover 11. The sealing member 12 is positioned and secured on the first cover 11 through the positioning sheet 123 and the securing sheet 124 to avoid displacement during use. It is possible to dispose one of the positioning piece 123 and the securing piece 124 to position and secure the sealing member 12 on the first cover 11, which would not be repeated herein.

In this embodiment, the sealing member 12 further comprises a sealing bump 125. The sealing bump 125 is disposed on an outer side 121*b* of the sealing body 121 and surrounds the sealing body 121. When the sealing member 12 is disposed on the first cover 11, the sealing bump 125 would be in contact with the inner surface of the first sleeve 10. The contacting area of the sealing body 121 and the inner surface of the first sleeve 10 can be reduced through the sealing bump 125 to lower the friction between the sealing body 121 and the inner surface of the first sleeve 10. In this way, the first sleeve 10 can be sleeved on the first cover 11 and the sealing member 12, and the sealing member 12 can also seal the gap between the sealing body 121 and the inner surface of the first sleeve 10, allowing the electrical connector 1 to be well water-proofed. In this embodiment, the number of sealing bumps 125 is one. The number of sealing bumps 125 can be multiple. The plurality of sealing bumps 125 is disposed on an outer side edge 121*b* of the sealing body 121 at intervals.

In summary, embodiments of the present disclosure provide an electrical connector and a connector assembly. The sealing sheet is in contact with the second connecting end surface of the second sleeve of the mating connector and the side surface of the second cover to perform waterproofing of the electrical connector, which reduces friction between the mating connector and the sealing sheet of the sealing member during plugging and unplugging to avoid wear and elastic fatigue of the sealing member. Thus, the waterproof performance of the sealing member could be maintained in excellent condition when it is used for a longer period of time, and the service life of the sealing member can be greatly increased.

It is to be understood that the term "comprises", "comprising", or any other variants thereof, is intended to encompass a non-exclusive inclusion, such that a process, method, article, or device of a series of elements not only comprise those elements but further comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. An electrical connector, comprising:

a first sleeve comprising a first mating opening and a first connecting end surface, the first connecting end surface being disposed at the periphery of the first mating opening;

a first cover disposed in the first sleeve, the first cover comprising a first mating surface exposed from the first mating opening; and a sealing member disposed on a side surface of the first cover, surrounding the first cover, the sealing member being disposed between the first sleeve and the first cover, the sealing member comprising a sealing body and a sealing sheet, the sealing sheet extending from the first mating surface in a direction close to the first connecting end surface of the first sleeve;

wherein, the sealing body and the sealing sheet are annular-shaped and the annular-shaped sealing sheet is inclined to the sealing body.

2. The electrical connector according to claim 1, wherein the sealing sheet comprises a first side and a second side; the first side of the sealing sheet is connected with the sealing body; the sealing sheet is disposed at one side of the sealing body; a gap distance exists between a side edge of the second side of the sealing sheet and the sealing body; the sealing body is disposed on the side surface of the first cover and surrounds the first cover; the second side extends from the first side in a direction away from the sealing body; the extending length of the second side relative to the first side is greater than the gap distance.

3. The electrical connector according to claim 2, wherein the cross-sectional surface of the sealing sheet along a direction orthogonal to the first mating surface is an inclined surface, a curved surface, or a bent surface.

4. The electrical connector according to claim 2, wherein an outer side edge of the sealing body is in contact with an inner surface of the first sleeve.

5. The electrical connector according to claim 2, wherein the sealing member further comprises a positioning sheet disposed on an inner side edge of the sealing body; the positioning sheet extends toward an inner space surrounded by the sealing body; the positioning sheet covers a part of the first mating surface of the first cover.

6. The electrical connector according to claim 5, wherein the sealing member further comprises a securing sheet disposed on the inner side edge of the sealing body; the securing sheet extends toward the inner space surrounded by the sealing body; the side surface of the first cover comprises a connecting groove in which the securing sheet is disposed.

7. The electrical connector according to claim 2, wherein the sealing member further comprises a securing sheet disposed on an inner side edge of the sealing body; the securing sheet extends toward an inner space surrounded by the sealing body; the side surface of the first cover comprises a connecting groove in which the securing sheet is disposed.

8. The electrical connector according to claim 2, wherein the sealing member further comprises a sealing bump disposed on an outer side edge of the sealing body; the sealing bump is in contact with an inner surface of the first sleeve.

9. The electrical connector according to claim 1, wherein two opposite sides of the first cover are respectively provided with a buckle; the buckle is disposed at one side of the first cover opposite to the first mating surface and extends in a direction away from the first mating surface; two opposite surfaces of the first sleeve are respectively provided with a recess with which the buckle is correspondingly buckled.

10. A connector assembly, comprising:

an electrical connector according to claim 1; and a mating connector comprising a second sleeve and a second cover, the second cover being disposed in the second sleeve, the second sleeve comprising a second connecting end surface, the second cover protruding from the second connecting end surface, when the mating connector being mated with the electrical connector, one side of the sealing sheet close to the first connecting end surface being in contact with the second connecting end surface of the second sleeve and a side surface of the second cover.

11. The connector assembly according to claim 10, wherein the two opposite inner surfaces of the first sleeve are respectively provided with a positioning groove disposed between the first connecting end surface and the first mating surface; two opposite outer surfaces of the second sleeve are respectively provided with a positioning bump disposed in the corresponding positioning groove.

12. The connector assembly according to claim 10, wherein the sealing member comprises a sealing body; the sealing sheet comprises a first side and a second side; the first side of the sealing sheet is connected with the sealing body; the sealing sheet is disposed at one side of the sealing body; a gap distance exists between a side edge of the second side of the sealing sheet and the sealing body; the sealing body is disposed on the side surface of the first cover and surrounds the first cover; the second side extends from the first side in a direction away from the sealing body; the extending length of the second side relative to the first side is greater than the gap distance.

13. The connector assembly according to claim 12, wherein the cross-sectional surface of the sealing sheet along a direction orthogonal to the first mating surface is an inclined surface, a curved surface, or a bent surface.

14. The connector assembly according to claim 12, wherein an outer side edge of the sealing body is in contact with an inner surface of the first sleeve.

15. The connector assembly according to claim 12, wherein the sealing member further comprises a positioning sheet disposed on an inner side edge of the sealing body; the positioning sheet extends toward an inner space surrounded by the sealing body; the positioning sheet covers a part of the first mating surface of the first cover.

16. The connector assembly according to claim 15, wherein the sealing member further comprises a securing sheet disposed on the inner side edge of the sealing body; the securing sheet extends toward the inner space surrounded by the sealing body; the side surface of the first cover comprises a connecting groove in which the securing sheet is disposed.

17. The connector assembly according to claim 12, wherein the sealing member further comprises a securing sheet disposed on an inner side edge of the sealing body; the securing sheet extends toward an inner space surrounded by the sealing body; the side surface of the first cover comprises a connecting groove in which the securing sheet is disposed.

18. The connector assembly according to claim 12, wherein the sealing member further comprises a sealing bump disposed on an outer side edge of the sealing body; the sealing bump is in contact with an inner surface of the first sleeve.

19. The connector assembly according to claim 10, wherein two opposite sides of the first cover are respectively provided with a buckle; the buckle is disposed at one side of the first cover opposite to the first mating surface and extends in a direction away from the first mating surface; two opposite surfaces of the first sleeve are respectively provided with a recess with which the buckle is correspondingly buckled.

* * * * *